US005744271A

United States Patent [19]

Aizawa et al.

[11] Patent Number: 5,744,271

[45] Date of Patent: Apr. 28, 1998

[54] PHOTOCONDUCTOR FOR ELECTROPHOTOGRAPHY

[75] Inventors: Koichi Aizawa; Shigemichi Ito, both of Nagano, Japan

[73] Assignee: Fuji Electric Co., Ltd., Kawasaki, Japan

[21] Appl. No.: 722,466

[22] Filed: Sep. 27, 1996

[30] Foreign Application Priority Data

Sep. 28, 1995 [JP] Japan ..... 7-250294

[51] Int. Cl.[6] ..... G03G 5/14

[52] U.S. Cl. ..... 430/58; 430/63; 430/65

[58] Field of Search ..... 430/62, 63, 64, 430/58, 65

[56] References Cited

U.S. PATENT DOCUMENTS

| | | | |
|---|---|---|---|
| 4,518,669 | 5/1985 | Yashiki | 430/63 |
| 5,556,728 | 9/1996 | Nogami et al. | 430/64 |

FOREIGN PATENT DOCUMENTS

| | | |
|---|---|---|
| 59-093453 | 5/1984 | Japan . |
| 60-168157 | 8/1985 | Japan . |
| 61-204642 | 9/1986 | Japan . |
| 63-234261 | 9/1988 | Japan . |
| 63-298251 | 12/1988 | Japan . |
| 3145652 | 6/1991 | Japan . |
| 4-172361 | 6/1992 | Japan . |
| 4172361 | 6/1992 | Japan . |
| 4294362 | 10/1992 | Japan . |

OTHER PUBLICATIONS

Borsenberger, Paul M. & David S. Weiss. Organic Photoreceptors of Imaging Systems. New York: Marcel–Dekker, Inc. pp. 28–31 & 289–292, 1993.

*Primary Examiner*—Christopher D. Rodee
*Attorney, Agent, or Firm*—Morrison Law Firm

[57] ABSTRACT

A photoconductor for electrophotography includes a conductive substrate and an organic undercoating layer on the conductive substrate. An organic charge generation layer is deposited on the undercoating layer, and an organic charge transport layer is deposited on the charge generation layer. The undercoating layer contains soluble polyamide resin and/or normal-butylated melamine resin as its main components. Alternately, the undercoating layer may contain resin as its main component, into which are dispersed small particles of anatase-type titanium dioxide. The surfaces of the anatase-type titanium dioxide particles may be treated with aminosilane. These undercoating layers produce a laminate-type photoconductor, which exhibits excellent electrophotographic characteristics that are stable during repeated use over long periods of time, and which vary little in a high temperature and high humidity atmosphere, as well as in a low temperature and low humidity atmosphere.

4 Claims, 1 Drawing Sheet

PHOTOCONDUCTOR FOR ELECTROPHOTOGRAPHY

BACKGROUND OF THE INVENTION

The present invention relates to a photoconductor for electrophotography. More specifically, the present invention relates to an undercoating layer of a laminate-type organic photoconductor.

Recently, laminate-type organic photoconductors have been developed and put into practical use. As disclosed in Japanese Unexamined Laid Open Patent Applications No. S60-34099 and No. JP-A60-168157, the laminate-type organic photoconductor includes an organic charge generation layer laminated on a conductive substrate, and an organic charge transport layer laminated on the charge generation layer. The charge generation layer is formed by coating on a conductive substrate an organic solvent containing a dispersed organic charge generating agent and resin binder. After coating, the charge generation layer is dried. The charge transport layer is formed by coating and drying, on the charge generation layer, an organic solvent containing an organic charge transport agent, resin binder and an appropriate additive.

In photoconductors having the above described structure, coating of the thin charge generation layer on conductive substrate is affected by the nature of the substrate surface. Difficulties in forming a charge generation layer of uniform thickness and quality result in layer thickness deviations, as well as various defects in image quality and print density.

To overcome these difficulties, a resin layer, termed an undercoating layer or an intermediate layer, is often interposed between the conductive substrate and the charge generation layer. A layer formed by coating and drying an alcohol-soluble polyamide resin creates an effective undercoating or intermediate layer (Japanese Examined Patent Application No. S58-45707 and Japanese Unexamined Laid Open Patent Application No. S60-168157).

Such a conventional undercoating layer provides excellent initial electrical properties and image quality. However, over time, repeated use results in accumulation of electric charges, and produces various defects such as black spots, memory phenomena and printing density deviations. Additionally, repeated use causes the charge generation layer to peel off, or separate, from the undercoating layer, due to poor adhesiveness between the conventional undercoating and the charge generation layers. The peeling off causes further image defects and failure of the electrophotographic apparatus.

OBJECTS AND SUMMARY OF THE INVENTION

It is an object of the invention to provide a laminate type organic photoconductor for electrophotography which exhibits excellent electrophotographic characteristics.

It is another object of the invention to provide a laminate type organic photoconductor, whose photoconductive properties remain stable despite repeated use for long periods of time.

It is still another object of the invention to provide a laminate type organic photoconductor which exhibits excellent and stable image quality.

It is still another object of the invention to provide a laminate type organic photoconductor whose characteristics remain constant even when the environmental conditions vary widely.

Briefly stated, the organic photoconductor of the invention includes a conductive substrate, an organic undercoating layer on the substrate, an organic charge generation layer on the undercoating layer, and an organic charge transport layer on the charge generation layer. The undercoating layer contains at least one of a soluble polyamide resin and normal-butylated melamine resin as the main components thereof. Alternately, the undercoating layer may contain resin as the main component, into which are dispersed anatase-type titanium dioxide small particles. The surfaces of the anatase-type titanium dioxide small particles may be further treated with aminosilane.

According to an aspect of the invention, there is provided a photoconductor for electrophotography which includes a conductive substrate; an undercoating layer on the conductive substrate, the undercoating layer containing soluble polyamide resin and normal-butylated melamine resin as the main components thereof; an organic charge generation layer on the undercoating layer; and an organic charge transport layer on the charge generation layer.

According to another aspect of the invention, there is provided a photoconductor for electrophotography which includes a conductive substrate; an undercoating layer on the conductive substrate, which contains resin and small particles of anatase-type titanium dioxide dispersed in the resin; an organic charge generation layer on undercoating layer; and an organic charge transport layer on the charge generation layer.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
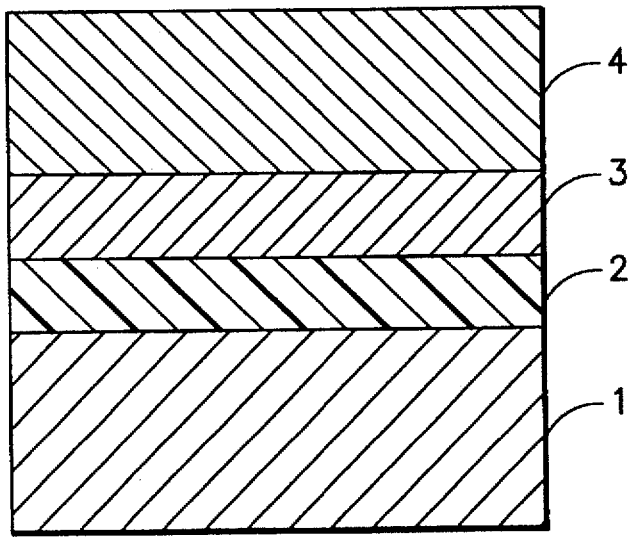
FIG. 1 is a cross section of a photoconductor for electrophotography of the present invention.

Referring to FIG. 1, a photoconductor according to the present invention includes an undercoating layer 2 laid on a conductive substrate 1. A charge generation layer 3 is coated on undercoating layer 2. A charge transport layer 4 is coated on charge generation layer 3. Undercoating layer 2 is made by coating conductive substrate 1 with a coating liquid which contains soluble polyamide resin and normal-butylated melamine resin as its main components. After drying, the resulting film is stable and acts as an excellent coating film. This coating film is stable, highly adhesive and resists being dissolved in the solvent of the coating liquid for charge generation layer 3. Preferably, undercoating layer 2 contains soluble polyamide resin or normal-butylated melamine resin as the main component, or undercoating layer 2 may contain both soluble polyamide resin and normal-butylated melamine resin as the main components. The electrical properties of undercoating layer 2 of the invention vary little with changes in the environment. Undercoating layer 2 of the invention results in excellent electrophotographic images in a low temperature, low humidity atmosphere as well as in a high temperature, high humidity atmosphere.

Alternately, a high quality undercoating layer 2 is obtained by dispersing anatase-type titanium dioxide small particles into a soluble polyamide resin, normal-butylated melamine resin or a resin mixture containing soluble polyamide resin and normal-butylated melamine resin. Undercoating layer 2 of this embodiment contains from 50 to 150 weight parts of the metal oxide small particles to 100 weight parts of the resin. In contrast, inclusion of rutile-type titanium dioxide particles in the resin does not produce photoconductors which exhibit excellent electrical characteristics. Thus, the crystal form of titanium dioxide is critical for realizing excellent electrical characteristics in the photoconductor. Although the reason for this is not certain, dielectric constant differences between the crystal forms of titanium dioxide may play an important role. It is well known that the dielectric constants of certain transition metal oxides differ among crystal forms. In particular, the dielectric constant of anatase-type titanium dioxide is 48, much smaller than 114, the dielectric constant of rutile-type titanium dioxide. Therefore, a weaker electric field may be generated by anatase-type titanium dioxide in undercoating layer 2 than by rutile-type titanium dioxide.

Moreover, by dispersing small particles of anatase-type titanium dioxide in undercoating layer 2, interference fringes due to light reflected from the substrate do not occur when the photoconductor of the invention is mounted on an electrophotographic apparatus which uses a monochromatic exposure light such as a laser beam.

It is further preferable to use in undercoating layer 2 small particles of anatase-type titanium oxide, the surfaces of which have been treated with aminosilane. The surface treatment with aminosilane improves dispersion of the particles in undercoating layer 2, elongates the pot-life of the coating liquid for undercoating layer 2 and facilitates stable formation of undercoating layer 2. The surface treatment may be conducted by coating the particle surface with silane having —OH and amino groups.

Referring now to FIG. 1, a photoconductor according to the present invention includes a conductive substrate 1. An undercoating layer 2 is deposited on substrate 1. A charge generation layer 3 is deposited on undercoating layer 2. A charge transport layer 4 is deposited on charge generation layer 3.

Conductive substrate 1 is made of conventional material, such as an aluminum alloy of JIS3003 series, JIS5000 series and JIS6000 series, other metals and conductive resins. Though conductive substrate 1 may be a plate, sheet or cylindrical tube, in preferred embodiment herein conductive substrate 1 is shaped as a cylindrical tube, in order to facilitate the design of the electrophotographic apparatus.

The cylindrical tubular conductive substrate 1 may be made of an aluminum alloy by rolling, extrusion or by pulling. Alternately, the cylindrical tubular conductive substrate 1 may be made of resin by, for example, extrusion or molding. If necessary, the outer peripheral surface of conductive substrate 1 is roughened to an appropriate surface roughness by cutting with a diamond tool before undercoating layer 2 is formed. Then, the surface of conductive substrate 1 is cleaned to remove cutting oil. Though chlorine-containing organic solvents such as trichlene and Freon were used in the past, more recently aqueous detergents, such as weakly alkaline detergents, are used due to environmental considerations.

Undercoating layer 2 is formed on thus fabricated conductive substrate 1. Undercoating layer 2 may include either soluble polyamide resin or normal-butylated melamine resin, or a mixture of both, as the main component. Alternately, undercoating layer 2 may be a resin, comprised of any of the above, into which small particles of anatase-type titanium dioxide are dispersed. Alternately, the small particles of anatase-type titanium dioxide dispersed throughout the resin may be first treated with aminosilane. Undercoating layer 2 is formed by dipping or spraying a coating liquid onto a substrate. The coating liquid is prepared by dispersing or dissolving one of the above described resin materials into an appropriate organic solvent. If necessary, an additional ingredient, such as a curing agent and/or a conductivity provider agent, may be added to the coating liquid. After coating, the film coat is dried and hardened. The hardening temperature and time are determined by considering the glass transition temperature of the resin, the curing temperature of the curing agent and the boiling point of the organic solvent. Sometimes, the hardening is conducted through two steps. The preferred thickness of undercoating layer 2 is from 0.1 to 0.5 μm.

If necessary, the thus formed undercoating layer 2 is reformed in order to improve adhesion to charge generation layer 3, which will be formed later on undercoating layer 2. To this end, undercoating layer 2 is exposed to a plasma, ultraviolet light or ozone. For example, by irradiating undercoating layer 2 with ultraviolet light of 184.9 nm and 253 nm, molecular bonds on the surface of undercoating layer 2 are cut and the surface of undercoating layer 2 is activated to improve the adhesiveness.

Next, a charge generation layer 3 is formed on undercoating layer 2. Charge generation layer 3 is formed by coating undercoating layer 2 with a coating liquid in which a charge generating agent is dissolved, along with an appropriate resin binder. Any charge generating agent which exhibits sensitivity at the wavelength of the exposure light of the electrophotographic apparatus can be used. A phthalocyanine pigment, azo pigment, anthanthron pigment, perylene pigment, perynone pigment, squalene pigment, thiapyrylium pigment and quinacridone pigment may be used as the charge generating agent.

Finally, charge transport layer 4 is formed on charge generation layer 3 to finish the photoconductor. Charge transport layer 4 is formed by coating charge generation layer 3 with a coating liquid in which a charge transport agent is dispersed and dissolved, along with a resin binder. Poly(vinylcarbazole), oxadiazole, imidazole pyrazoline, hydrazone and stilbene are used as the charge transport agent. If necessary, an antioxidant and/or ultraviolet absorbing agent can be added to the coating liquid for charge transport layer 4.

FIRST EMBODIMENT

A cylindrical substrate tube of an aluminum alloy of JIS3003 series was fabricated by pulling. The substrate was 30 mm in outer diameter, 28 mm in inner diameter and 250 mm in length. The substrate surface was not intentionally roughened by cutting. The natural maximum surface roughness was 3 μm.

The substrate was cleaned by ultrasonic cleaning for 3 min. in a 5% aqueous detergent (MF-10 supplied from Lion Corp.), brush cleaning in the same detergent, ultrasonic cleaning for 3 min. in tap water, ultrasonic rinsing for 3 min. with pure water, rinsing with ultra-pure water and drying with pure hot water at 70° C.

A coating liquid for an undercoating layer was prepared by dissolving 8 weight parts of an alcohol-soluble polyamide resin (CM 8000 supplied from TORAY INDUSTRIES, INC.) and 2 weight parts of a normal-butylated melamine resin (Uban 2020 supplied from Mitsui Toatsu Chemicals, Inc.) into 90 weight parts of a solvent mixture containing methanol and methylene chloride at a weight ratio of 6 to 4.

The coating liquid was coated on the substrate by dip-coating and dried at 100° C. for 20 min. to form an undercoating layer of 2 μm in thickness. Neither swelling nor dissolution was caused by dipping the as formed undercoating layer in tetrahydrofuran for 24 hr.

The surface of the thus formed undercoating layer was reformed by irradiating, for 20 sec, with ultraviolet light from an ultraviolet irradiating apparatus (SUV200NS supplied from Sun Engineering Co., Ltd.). The surface of the undercoating layer was held 20 mm from the lamp and illuminated at 200V.

A coating liquid for the charge generation layer was prepared by dissolving 1 weight part of X-type metal-free phthalocyanine and 1 weight part of poly(vinyl butyral) into 98 weight parts of tetrahydrofuran. The coating liquid was dip-coated on the undercoating layer and dried to form a charge generation layer of 0.1 μm in thickness.

Then, a coating liquid for the charge transport layer was prepared by dissolving 10 weight parts of a hydrazone compound (CTC191 supplied from ANAN CORPORATION) and 10 weight parts of a polycarbonate resin (L-1225 supplied from TEIJIN CHEMICALS Ltd.) into 80 weight parts of dichloromethane. The coating liquid was dip-coated on the charge generation layer and dried to form a charge transport layer of 20 μm in thickness.

Running printing tests of the thus fabricated photoconductor were conducted in a laser printer having a semiconductor laser beam. Initially, the printing density was 1.40 (measured with a Mackbeth densitometer), white paper density was 0.07 and number of black spot of more than 0.1 mm in diameter was 4 per a round of the photoconductor. Peel-off of 0/100 was measured in a cross-cut adhesion test (specified by JIS K5400). Thus, the photoconductor of the embodiment exhibits excellent adhesiveness between the constituent layers.

After printing on 50,000 sheets of A4 size paper, the printing density was 1.40, white paper density 0.08, and number of black spots 5. Thus, the repeated use of the photoconductor of the embodiment did not cause any appreciable difference from the initial test results. Also, no peel-off occurred during the running test.

During the printing test in a high temperature and high humidity atmosphere (temperature: 35° C., relative humidity: 85%), fogging or minute black spots were not observed. Also, the photoconductor of this embodiment exhibited excellent image resolution and printing density. During the printing test in a low temperature and low humidity atmosphere (temperature: 5° C., relative humidity: 20%), print density lowering and memory phenomena due to white potential rise were not caused.

COMPARATIVE EXAMPLE 1.

A photoconductor of a comparative example 1 was fabricated in the same manner as the photoconductor of the first embodiment, except that a coating liquid for the undercoating layer did not contain any normal-butylated melamine resin. The coating liquid for the undercoating layer was prepared by dissolving 10 weight parts of an alcohol-soluble polyamide resin (CM 8000 supplied from TORAY INDUSTRIES, INC.) into 90 weight parts of a solvent mixture containing methanol and methylene chloride at a volume ratio of 6 to 4.

The printing test was conducted on the photoconductor of the comparative example 1 in the same way as on the first embodiment. Initially, the printing density was 1.41, white paper density was 0.06 and number of black spots was 2 per a round of the photoconductor. Though the initial characteristics were excellent, memory phenomena due to white potential rise were caused in a low temperature and low humidity atmosphere (temperature: 10° C., relative humidity: 30%) and minute black spots were generated when the test was run in the high temperature and high humidity atmosphere (temperature: 35° C., relative humidity: 85%).

The foregoing tests demonstrate that the normal-butylated melamine resin contained in the undercoating layer contributes to maintenance of excellent printing characteristics. These high-quality printing characteristics are maintained through a wide range of environmental conditions. Though the reason for this is not certain, it is believed that the end groups of the polyamide and melamine resins link to each other to lower the hygroscopicity of the undercoating layer. With lower hygroscopicity, the printing characteristics may exhibit less humidity dependence.

COMPARATIVE EXAMPLE 2

A photoconductor of a comparative example 2 was fabricated in the same manner as the photoconductor of the first embodiment except that the coating liquid for the undercoating layer of the comparative example 2 was prepared by dissolving 10 weight parts of an alcohol-soluble polyamide resin (CM 8000 supplied from TORAY INDUSTRIES, INC.) and 5 weight parts of a butylated urea-melamine resin into 90 weight parts of a solvent mixture containing methanol and methylene chloride at a volume ratio of 6 to 4.

COMPARATIVE EXAMPLE 3

A photoconductor of a comparative example 3 was fabricated in the same manner as the photoconductor of the first embodiment except that the coating liquid for the undercoating layer of the comparative example 3 was prepared by dissolving 10 weight parts of an alcohol-soluble polyamide resin (CM 8000 supplied from TORAY INDUSTRIES, INC.) and 5 weight parts of an isobutylated melamine resin into 90 weight parts of a solvent mixture containing methanol and methylene chloride at a volume ratio of 6 to 4.

Significant defects in the printing characteristics occurred when the photoconductors of the comparative examples 2 and 3 were tested in the low temperature, low humidity atmosphere, as well as in the high temperature and high humidity atmosphere. Therefore, the normal-butylated melamine resin is preferable for the resin of the undercoating layer.

SECOND EMBODIMENT

A photoconductor of a second embodiment was fabricated in the same manner as the photoconductor of the first embodiment except its conductive substrate was fabricated by injection molding a stuff containing 20 weight parts of highly conductive carbon black and 50 weight parts of cross-linked polyphenylene sulfide.

The photoconductor of the second embodiment was evaluated by the running printing test in the same way as the photoconductor of the first embodiment. Initially, the printing density was 1.41, white paper density was 0.06 and number of black spots was 2 per a round of the photoconductor. Peel-off of 0/100 was measured in a cross-cut adhesion test. After printing on 50,000 sheets of A4 size paper, the printing density was 1.40, white paper density 0.06, and number of black spots 3. Also, no peel-off occurred during the running test.

No degradation of printing quality occurred when the printing tests were run in the high temperature, high humidity atmosphere, nor in the low temperature, low humidity atmosphere.

THIRD EMBODIMENT

An aluminum alloy cylindrical substrate tube, the composition of which is listed below in table 1, was fabricated to be 30 mm in outer diameter, 28 mm in inner diameter and 250 mm in length. The outer peripheral surfaces of the substrate was roughened with a diamond cutting tool to have a maximum surface roughness of 0.5 μm.

TABLE 1

| | Elements | | | | | | | | |
|---|---|---|---|---|---|---|---|---|---|
| | Si | Fe | Cu | Mn | Mg | Cr | Zr | Ti | Al |
| Composition (wt %) | 0.04 | 0.02 | — | — | 0.48 | — | — | — | rest |

The substrate was cleaned in the same manner as in the first embodiment.

A coating liquid for the undercoating layer was prepared by dissolving and dispersing 5 weight parts of an alcohol-soluble polyamide resin (CM 8000 supplied from TORAY INDUSTRIES, INC.) and 5 weight parts of anatase-type titanium dioxide (P25 supplied from Nippon Aerosil Co., Ltd.) into 90 weight parts of a solvent mixture containing methanol and methylene chloride at a volume ratio of 6 to 4. The coating liquid was coated on the above described substrate by dip-coating, and dried at 100° C. for 20 min. to form an undercoating layer of 2 μm in thickness. Neither swelling nor dissolution was caused by dipping the as formed undercoating layer in tetrahydrofuran for 24 hr.

The surface of the thus formed undercoating layer was reformed by irradiating with ultraviolet light in the same way as in the first embodiment. Then, charge generation and transport layers were formed in the same manner as in the first embodiment.

The printing test was conducted on the photoconductor of the third embodiment in the same way as on the first embodiment. Initially, the printing density was 1.40, white paper density was 0.07 and number of black spots was 4 per a round of the photoconductor. Peel-off of 0/100 was measured in a cross-cut adhesion test. Thus, the photoconductor of the embodiment exhibited excellent adhesiveness between the constituent layers.

After printing on 50,000 sheets of A4 size paper, the printing density was 1.40, white paper density 0.08, and number of black spots 5. Thus, repeated use of the photoconductor of the third embodiment did not cause any appreciable change from the initial test results. Also, no peel-off occurred during the running test.

COMPARATIVE EXAMPLE 4

A photoconductor of a comparative example 4 was fabricated in the same manner as the third embodiment, except that the anatase-type titanium oxide of the third embodiment was replaced by rutile-type titanium oxide.

A printing test was conducted on the photoconductor of the comparative example 4 in the same way as on the first embodiment. Initially, the printing density was 1.41, white paper density was 0.06 and number of black spots was 2 per a round of the photoconductor. Though the initial characteristics were excellent, memory phenomena due to white potential rise were caused in a low temperature and low humidity atmosphere. Therefore, anatase-type titanium dioxide is preferred to rutile-type titanium dioxide, if titanium dioxide is included in the undercoating layer.

FOURTH EMBODIMENT

A photoconductor of a fourth embodiment was fabricated in the same manner as the photoconductor of the third embodiment, except its conductive substrate was fabricated by injection molding a stuff containing 20 weight parts of highly conductive carbon black and 50 weight parts of crosslinked polyphenylene sulfide.

The photoconductor of the fourth embodiment was evaluated by the printing test in the same way as the photoconductor of the first embodiment. Initially, the printing density was 1.41, white paper density was 0.06 and number of black spots was 2 per a round of the photoconductor. Peel-off of 0/100 was measured in a cross-cut adhesion test. After printing on 50,000 sheets of A4 size paper, the printing density was 1.40, white paper density 0.06, and number of black spots 3. Also, no peel-off occurred during the running test.

During the printing test in a high temperature and high humidity atmosphere, fogging or minute black spots were not observed. Also, the photoconductor of the fourth embodiment exhibited excellent image resolution and printing density. During the printing test in a low temperature and low humidity atmosphere, printing density lowering and memory phenomena due to white potential rise did not occur.

FIFTH EMBODIMENT

A photoconductor of a fifth embodiment was fabricated in the similar way as in the third embodiment, except its undercoating layer was formed in a different manner.

A coating liquid for the undercoating layer was prepared by dissolving and dispersing 10 weight parts of a normal-butylated melamine resin (Uban 20HS supplied from Mitsui Toatsu Chemical, Inc.), 1 weight part of ammonium benzoate and 5 weight parts of small particles of anatase-type titanium dioxide (P25 supplied from Nippon Aerosil Co., Ltd.) into 90 weight parts of a solvent mixture containing methanol and methylene chloride at a volume ratio of 6 to 4. The coating liquid was coated on the substrate by dip-coating, and dried at 100° C. for 20 min. to form an undercoating layer of 2 μm in thickness. Neither swelling nor dissolution was caused by dipping the as formed undercoating layer in tetrahydrofuran for 24 hr.

The surface of the thus formed undercoating layer was reformed by irradiating with ultraviolet light in the same way as in the first embodiment. A charge generation layer was then formed on the undercoating layer in the same manner as the charge generation layer of the third embodiment. A coating liquid for the charge transport layer was prepared by dissolving 10 weight parts of a hydrazone compound (CTC191 supplied from ANAN CORPORATION) and 10 weight parts of a polycarbonate resin (K-1300 supplied from TEIJIN CHEMICALS Ltd.) into 80 weight parts of dichloromethane. The coating liquid was dip-coated on the charge generation layer and dried to form a charge transport layer of 20 μm in thickness.

The photoconductor of the fifth embodiment was evaluated by the running printing test in the same way as on the first embodiment. Initially, the printing density was 1.40, white paper density was 0.07 and number of black spots was 4 per a round of the photoconductor. Peel-off of 0/100 was measured in a cross-cut adhesion test.

After printing on 50,000 sheets of A4 size paper, the printing density was 1.40, white paper density 0.06, and number of black spots 3. Also, no peel-off occurred during the running test. No white potential rise was observed in the low temperature and low humidity atmosphere. Also, no minute black spots were observed in a high temperature and high humidity atmosphere.

COMPARATIVE EXAMPLE 5

A photoconductor of a comparative example 5 was fabricated in the same manner as the fifth embodiment, except that the anatase-type titanium oxide small particles of the fifth embodiment were replaced by small particles of rutile-type titanium oxide.

A printing test was conducted on the photoconductor of the comparative example 5 in the same way as on the first embodiment. Initially, the printing density was 1.41, white paper density was 0.06 and number of black spots was 2. Though the initial characteristics were excellent, memory phenomena due to white potential rise were caused in a low temperature and low humidity atmosphere (temperature: 10° C., humidity: 30%). Therefore, when titanium dioxide is to be included in the undercoating layer, anatase-type titanium dioxide is preferred over rutile-type titanium dioxide.

SIXTH EMBODIMENT

A photoconductor of a sixth embodiment was fabricated in the same manner as the photoconductor of the fifth embodiment, except its conductive substrate was fabricated by injection molding a stuff containing 20 weight parts of highly conductive carbon black and 50 weight parts of crosslinked polyphenylene sulfide.

The photoconductor of the sixth embodiment was evaluated by the running printing test in the same way as on the first embodiment. Initially, the printing density was 1.41, white paper density was 0.06 and number of black spots was 2 per a round of the photoconductor. Peel-off of 0/100 was measured in a cross-cut adhesion test. After printing on 50,000 sheets of A4 size paper, the printing density was 1.42, white paper density 0.06, and number of black spots 3. Also, no peel-off occurred during the running test.

During the printing test in a high temperature and high humidity atmosphere, no fogging or minute black spots were observed. Also, the photoconductor of the fourth embodiment exhibited excellent resolution and printing density. During the printing test in a low temperature and low humidity atmosphere, print density lowering and memory phenomena due to white potential rise did not occur.

SEVENTH EMBODIMENT

A photoconductor of a seventh embodiment was fabricated in the similar way as in the fifth embodiment, except its undercoating layer was formed in a different manner.

A coating liquid for the undercoating layer of the seventh embodiment was prepared by dissolving 80 weight parts of a methoxymethylated polyamide resin (MF30 supplied from Teikoku Chemical Co., Ltd.) and 20 weight parts of normal-butylated melamine resin (Uban 20HS supplied from Mitsui Toatsu Chemical, Inc.) into 700 weight parts of methyl alcohol, and by dispersing therein small particles of anatase-type titanium dioxide (P25 supplied from Nippon Aerosil Co., Ltd.) with the content thereof varied as described in Table 2 with respect to 100 weight parts of the above described resins. The coating liquids were dried at 90° C. for 15 min. and cured at 130° C. for 20 min.

The photoconductors according to the seventh embodiment were evaluated in the same manner as in the first embodiment. Print characteristics evaluated included initial printing density, initial white paper density, number of black spots, occurrence of memory phenomena, running test of printing on 50,000 sheets of A4 size paper, printing test in a high temperature and high humidity atmosphere and printing test in a low temperature and low humidity atmosphere. Results were correlated with the contents of anatase-type titanium dioxide, and were as shown in Table 2.

TABLE 2

| Anatase-type $TiO_2$ contents (wt %) | Initial Printing | Printing after running test | Printing under high temp & humidity | Printing under low temp & humidity | Overall Evaluation |
|---|---|---|---|---|---|
| 0 | memory | memory | ○ | memory | X |
| 5 | memory | memory | ○ | memory | X |
| 10 | memory | memory | ○ | memory | X |
| 20 | ○ | memory | ○ | memory | X |
| 50 | ○ | ○ | ○ | ○ | ○ |
| 80 | ○ | ○ | ○ | ○ | ○ |
| 100 | ○ | ○ | ○ | ○ | ○ |
| 120 | ○ | ○ | ○ | ○ | ○ |
| 150 | ○ | ○ | ○ | ○ | ○ |
| 180 | ○ | ○ | black spots | ○ | X |
| 200 | ○ | ○ | black spots | ○ | X |

As is evident from Table 2, the preferable content for the small particles of anatase-type titanium dioxide is from 50 to 150 weight parts with respect to the 100 weight parts of resin.

EIGHTH EMBODIMENT

A photoconductor of an eighth embodiment was fabricated in the similar way as the photoconductor of the fifth embodiment, except its undercoating layer was formed in a different manner.

A coating liquid for the undercoating layer of the eighth embodiment was prepared by dissolving and dispersing 40 weight parts of a methoxymethylated polyamide resin (MF30 supplied from Teikoku Chemical Co., Ltd.), 10 weight parts of normal-butylated melamine resin (Uban 20HS supplied from Mitsui Toatsu Chemical, Inc.) and 50 weight parts of anatase-type titanium dioxide small particles into 700 weight parts of methyl alcohol. The surfaces of the anatase-type titanium dioxide small particles were previously treated with aminosilane. The coating liquid was dried at 90° C. for 15 min. and cured at 130° C. for 20 min.

The photoconductor of the eighth embodiment was evaluated by the printing test in the same way as the photoconductor of the first embodiment. Initially, the printing density was 1.40, white paper density was 0.07 and number of black spots was 4. Peel-off of 0/100 was measured in a cross-cut adhesion test. After printing on 50,000 sheets of A4 size paper, the printing density was 1.40, white paper density 0.08, and number of black spots 5. Also, no peel-off occurred during the running test.

No degradation of printing quality occurred when the printing tests were run in the high temperature, high humidity atmosphere or in the low temperature, low humidity atmosphere. Thus, the photoconductor of the eighth embodiment exhibits excellent printing quality.

NINTH EMBODIMENT

A photoconductor of an ninth embodiment was fabricated in the similar way as in the fifth embodiment, except its undercoating layer was formed in a different manner.

A coating liquid for the undercoating layer of the ninth embodiment was prepared by dissolving and dispersing 40 weight parts of a copolymerized polyamide resin (T171 supplied from Daicel Huls Ltd.), 10 weight parts of normal-butylated melamine resin (Uban 20HS supplied from Mitsui Toatsu Chemical, Inc.) and 50 weight parts of anatase-type titanium dioxide small particles, the surfaces thereof previously having been treated with aminosilane, into 700 weight parts of methyl alcohol. The coating liquid was dried at 90° C. for 15 min. and cured at 130° C. for 20 min.

The photoconductor of the ninth embodiment was evaluated by the printing test in the same way as the photoconductor of the first embodiment. Initially, the printing density was 1.40, white paper density was 0.07 and number of black spots was 4. Peel-off of 0/100 was measured in a cross-cut adhesion test. After printing on 50,000 sheets of A4 size paper, the printing density was 1.40, white paper density 0.08, and number of black spots 5. Also, no peel-off occurred during the running test. Moreover, no defects in print quality were generated when the printing tests were run in either the high temperature, high humidity atmosphere or in the low temperature, low humidity atmosphere. Thus, the photoconductor of the ninth embodiment exhibits excellent printing quality.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A photoconductor for electrophotography comprising:

a conductive substrate;

an undercoating layer on said conductive substrate, said undercoating layer containing resin and particles of metal oxide dispersed in said resin;

said resin including soluble polyamide resin as a main component thereof;

said particles of metal oxide being anatase titanium dioxide;

surfaces of said particles of metal oxide being coated with aminosilane;

an organic charge generation layer on said undercoating layer; and an organic charge transport layer on said charge generation layer.

2. The photoconductor according to claim 1, wherein said undercoating layer contains from about 50 to 150 weight parts of said particles of metal oxide to about 100 weight parts of said resin.

3. The photoconductor according to claim 1, wherein said undercoating layer further contains normal-butylated melamine resin as a main component thereof.

4. The photoconductor according to claim 1, wherein:

said undercoating layer contains from about 50 to 150 weight parts of said metal oxide to about 100 weight parts of said resin; and said undercoating layer further contains normal-butylated melamine resin as a main component thereof.

* * * * *